US005895144A

United States Patent [19]

Nishimura

[11] Patent Number: 5,895,144

[45] Date of Patent: Apr. 20, 1999

[54] DEVELOPING DEVICE WITH MAGNETIC FIELD CONTROL FEATURE

[75] Inventor: Akimasa Nishimura, Kawasaki, Japan

[73] Assignee: Canon Kabushiki Kaisha, Tokyo, Japan, JPX

[21] Appl. No.: 08/888,605

[22] Filed: Jul. 7, 1997

[30] Foreign Application Priority Data

Jul. 10, 1996 [JP] Japan ..... 8-198522

[51] Int. Cl.[6] ..... G03G 15/08; G03G 21/00

[52] U.S. Cl. ..... 399/104; 399/98; 399/286

[58] Field of Search ..... 399/98, 102–104, 399/279–286

[56] References Cited

U.S. PATENT DOCUMENTS

| | | | |
|---|---|---|---|
| 4,213,617 | 7/1980 | Salger . | |
| 4,596,455 | 6/1986 | Kohyama et al. . | |
| 4,697,914 | 10/1987 | Hauser . | |
| 5,084,733 | 1/1992 | Katoh et al. . | |
| 5,187,326 | 2/1993 | Shirai . | |
| 5,202,729 | 4/1993 | Miyamoto et al. . | |
| 5,267,007 | 11/1993 | Watanabe et al. . | |
| 5,287,148 | 2/1994 | Sakemi et al. . | |
| 5,552,864 | 9/1996 | Malicki et al. . | |
| 5,592,268 | 1/1997 | Uehara et al. | 399/276 |
| 5,596,392 | 1/1997 | Danzuka | 399/98 |
| 5,606,397 | 2/1997 | Honda et al. | 399/98 |
| 5,655,178 | 8/1997 | Ishikawa et al. | 399/102 |
| 5,742,875 | 4/1998 | Bogoshian et al. | 399/104 |
| 5,742,876 | 4/1998 | Bogoshian | 399/104 |

*Primary Examiner*—Richard Moses

*Attorney, Agent, or Firm*—Fitzpatrick, Cella, Harper & Scinto

[57] ABSTRACT

A developing device includes a developing sleeve for bearing and conveying a magnetic developer, a magnet provided within the developing sleeve, and magnetic members, provided so as to face end portions of the developing sleeve with a gap, for forming a magnetic seal by a magnetic field formed between the magnetic members and the magnet. The magnet or each of the magnetic members has a plurality of grooves for forming a leakage magnetic field.

24 Claims, 11 Drawing Sheets

DEVELOPING DEVICE WITH MAGNETIC FIELD CONTROL FEATURE

BACKGROUND OF THE INVENTION

1. Field of the Invention

This invention relates to a developing devices which is used in an electrophotographic or electrostatic-recording image forming apparatus, such as a copier, a printer or the like, for developing an electrostatic latent image.

2. Description of the Related Art

Developing devices having various configurations for developing an electrostatic latent image formed on an image bearing member according to an electrophotographic or electrostatic recording method using a developer, comprising magnetic particles or particles including magnetic particles, have been proposed.

FIG. 9 illustrates such a developing devices In FIG. 9, a developing device 101 includes a developing receptacle 2 for accommodating a developer T configured as described above. Stirring means 7 and 8 are provided within the developing receptacle 2. The developer T is stirred and conveyed by the stirring means 7 and 8 within the developing receptacle 2.

In order to convey the developer T within the developing receptacle 2 toward an image bearing member 11 for the purpose of developing an electrostatic latent image formed on the image bearing member 11, the developing device 101 includes a developing roller 3 which serves as a magnetic-particle bearing member or a developer bearing member. Usually, as shown in FIG. 9, the developing roller 3 comprises a fixed magnet roller 3*a*, and a developing sleeve 3*b* mounted around the magnet roller 3*a* so as to be rotatable in the direction of the arrow, for conveying the developer T toward the image bearing member 11. As shown in FIG. 10, a shaft 3*c* of the developing sleeve 3*b* is supported on both side walls 2*a* of the developing receptacle 2 by bearings 9. In FIG. 10, only one of the side walls 2*a* is shown.

According to this configuration, the developer T is conveyed from an $S_3$ pole to an $N_1$ pole by the rotation of the developing sleeve 3*b*, and is formed on the developing sleeve 3*b* as a developer thin layer by being regulated by a regulating blade 4 supported by a supporting plate 5. An $N_2$ pole is a developing main pole, where the developer T develops the electrostatic latent image formed on the image bearing member 11. Then, the developer T is recollected within the developing receptacle 2 by the rotation of the developing sleeve 3*b*.

In the developing device 101 having the above-described configuration, the developer T circulated and moved within the developing receptacle 2 may be conveyed toward the bearings 9 along the surface of the developing sleeve 3*b* and leak from the developing receptacle 2 into the main body of the apparatus via the bearings 9, thereby causing various kinds of problems.

In order to prevent such leakage of the developer T, an attempt has been made, as described in Japanese Patent Laid-Open Application (Kokai) No. 2-262127 (1990), in which magnetic members 106 are disposed so as to face both end portions of the developing sleeve 3*b* along at least a part of the circumference of the developing sleeve 3*b* with a predetermined gap with the surface of the developing sleeve 3*b*. A magnetic circuit is formed by the magnetic members 106 and the magnet roller 3*a* disposed within the developing sleeve 3*b* so that magnetic lines of force are concentrated onto surfaces of the magnetic members 6 facing the developing sleeve 3*b*, to form a magnetic brush comprising the developer T in the gap portion along the magnetic lines of force. The leakage of the developer T from the developing receptacle 2 is prevented by the magnetic brush.

In such a conventional configuration, however, as shown in FIG. 11, a portion A where the magnetic lines of force are lacking, in some cases, depending on the arrangement of magnetic poles of the magnet roller 3*a*, and therefore the magnetic brush comprising the developer T is not formed. As a result, the leakage of the developer T is not prevented.

Particularly, according to an increase in the circumferential speed of the developing sleeve 3*b* due to an increase in the speed of the apparatus, and the provision of finer particles of the developer in order to improve the picture quality in recent apparatuses, the above-described conventional configuration does not satisfy a severe requirement for sealability against the developer.

SUMMARY OF THE INVENTION

It is an object of the present invention to provide a developing device in which the leakage of a developer from a portion between magnetic poles is prevented.

It is another object of the present invention to provide a developing device in which a leakage magnetic field is formed between magnetic poles.

According to one aspect, the present invention which achieves these objectives relates to a developing device including a developer bearing member for bearing and conveying a magnetic developer, a magnetic-field forming member provided within the developer bearing member, and magnetic members, provided so as to face end portions of the developer bearing member with a gap, for forming a magnetic seal by a magnetic field formed between the magnetic members and the magnetic-field forming member. Each of the magnetic members includes a plurality of grooves formed in a surface facing the developer bearing member.

According to another aspect, the present invention which achieves these objectives relates to a developing device including a developer bearing member for bearing and conveying a magnetic developers a magnetic-field forming member provided within the developer bearing member, and magnetic members, provided so as to face end portions of the developer bearing member with a gap, for forming a magnetic seal by a magnetic field formed between the magnetic members and the magnetic-field forming member. The magnetic-field forming member includes a plurality of grooves formed in a surface facing the magnetic members.

The foregoing and other objects, advantages and features of the present invention will become more apparent from the following description of the preferred embodiments taken in conjunction with the accompanying drawings.

DESCRIPTION OF THE PREFERRED EMBODIMENTS

A first embodiment of the present invention will now be described with reference to the drawings.

FIGS. 1 through 6 are cross-sectional views of a developing device according to the first embodiment and an image forming apparatus which uses the developing device.

Figure 4:
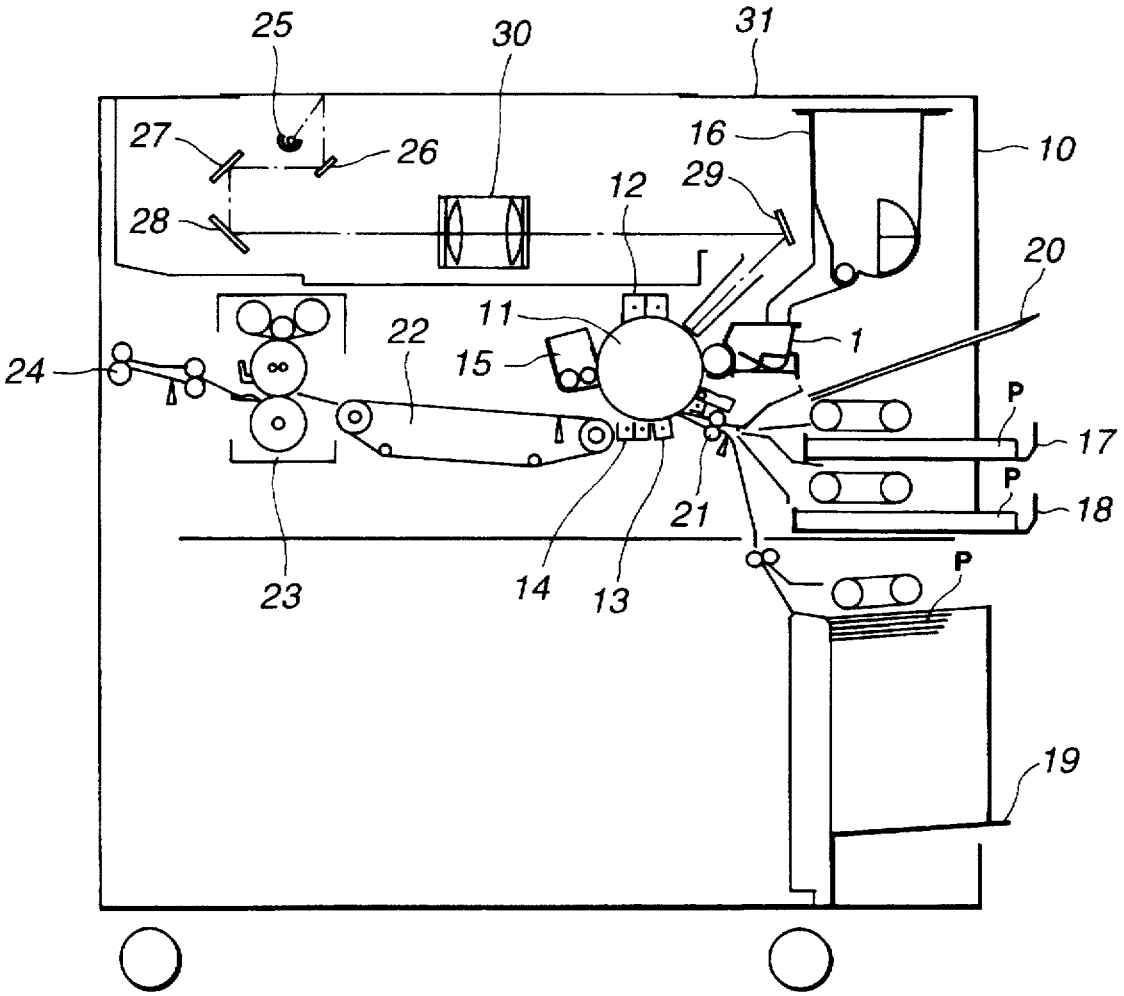
FIG. 4 is a vertical cross-sectional view of an electrophotographic copier including the developing device shown in FIG. 1.

FIG. 4 is a cross-sectional view of an electrophotographic copier, serving as the image forming apparatus which uses the developing device of the first embodiment.

In FIG. 4, a photosensitive drum 11, serving as an image bearing member, is rotatably accommodated within a main body 10 of the electroephotographic copier. Process units, such as a primary charger 12, a developing device 1 of the first embodiment, a transfer charger 13, a separation charger 14, a cleaner 15, and the like, are disposed around the photosensitive drum 11. A hopper 16 for replenishing a toner, serving as a developer, is provided above the developing device 1.

As shown in FIG. 4, sheet feeding cassettes 17, 18 and 19, each for accommodating a plurality of sheets of transfer paper P, are provided in three stages in the vertical direction at one side of the main body 10 of the apparatus. A tray 20 for manually inserting a sheet is provided above the sheet feeding cassette 17.

A sheet of the transfer paper P supplied from one of the sheet feeding cassettes 17, 18 and 19, or the manual sheet insertion tray 20 is conveyed from the right to the left in FIG. 4 within the main body 10 of the apparatus. Registration rollers 21, a conveying belt 22, a fixing device 23, sheet discharging rollers 24 and the like are disposed along the sheet conveying path.

A lamp 25, reflecting mirrors 26 through 29, an optical-system lens 30 and the like, which constitute an optical system, are disposed at an upper portion of the main body 10 of the apparatus.

An original (not shown) set on an original-mount 31 provided at an upper surface of the main body 10 of the apparatus is read by the optical systems When an optical image corresponding to the original is projected onto the rotating photosensitive drum 11, an electrostatic latent image is formed on the photosensitive drum 11. The formed electrostatic latent image is developed by the developing device 1 to provide a visual toner image.

A sheet of the transfer paper P is supplied, for example, from the sheet feeding cassette 17, and is conveyed to a transfer portion between the photosensitive drum 11 and the transfer charger 13 in synchronization with the registration rollers 21. The toner image formed on the photosensitive drum 11 is transferred onto the sheet of the transfer paper P. Then, the sheet is separated from the photosensitive drum 11 by the function of the separation charger 14.

The sheet of the transfer paper P separated from the photosensitive drum 11 is conveyed to the fixing device 23 by the conveying belt 22. The toner image on the sheet is fixed by the fixing device 23, and the sheet having the fixed image is discharged outside the apparatus by the sheet discharging rollers 24.

Figure 9:
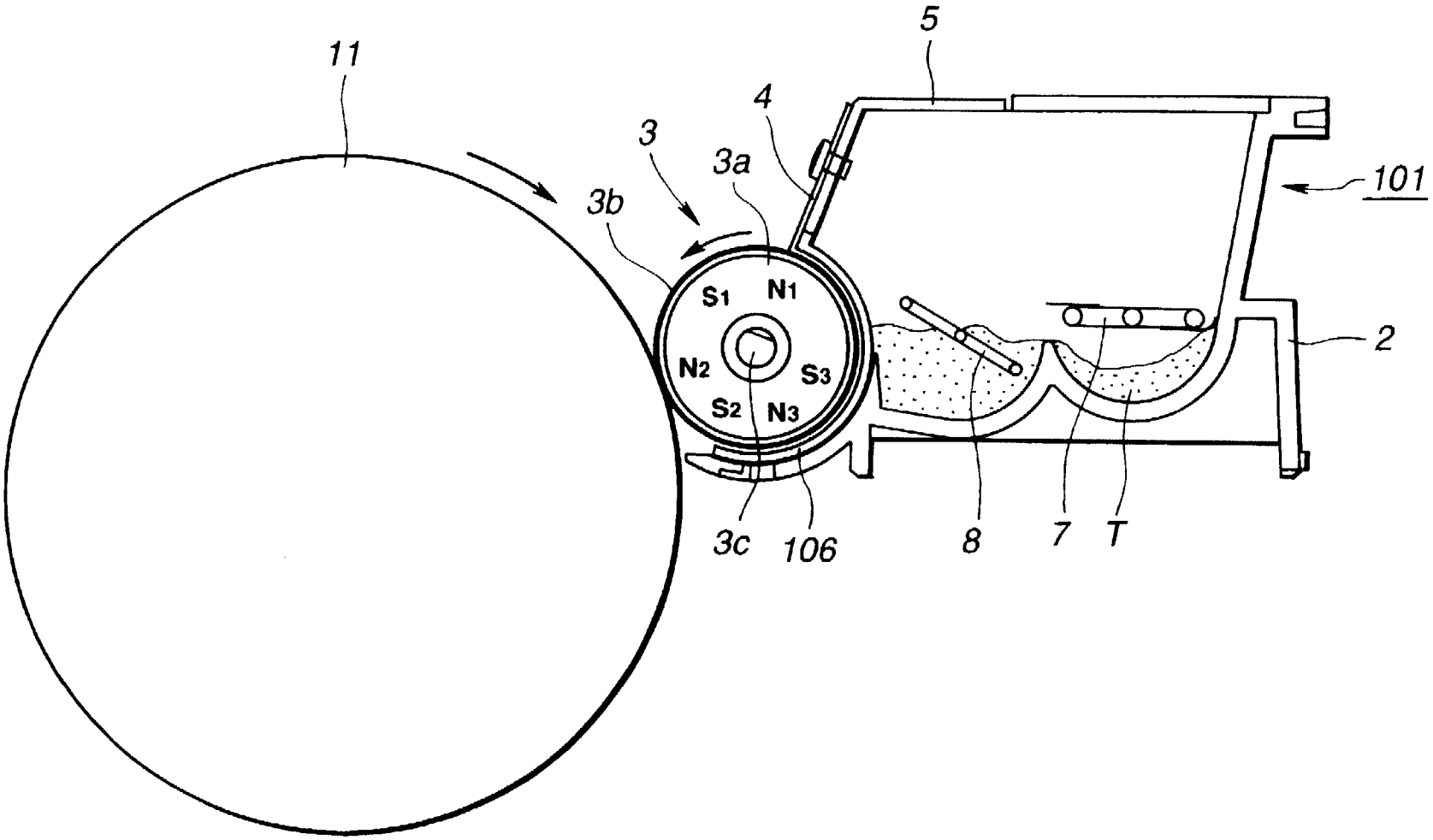
FIG. 9 is a cross-sectional view of a developing device.
Figure 10:
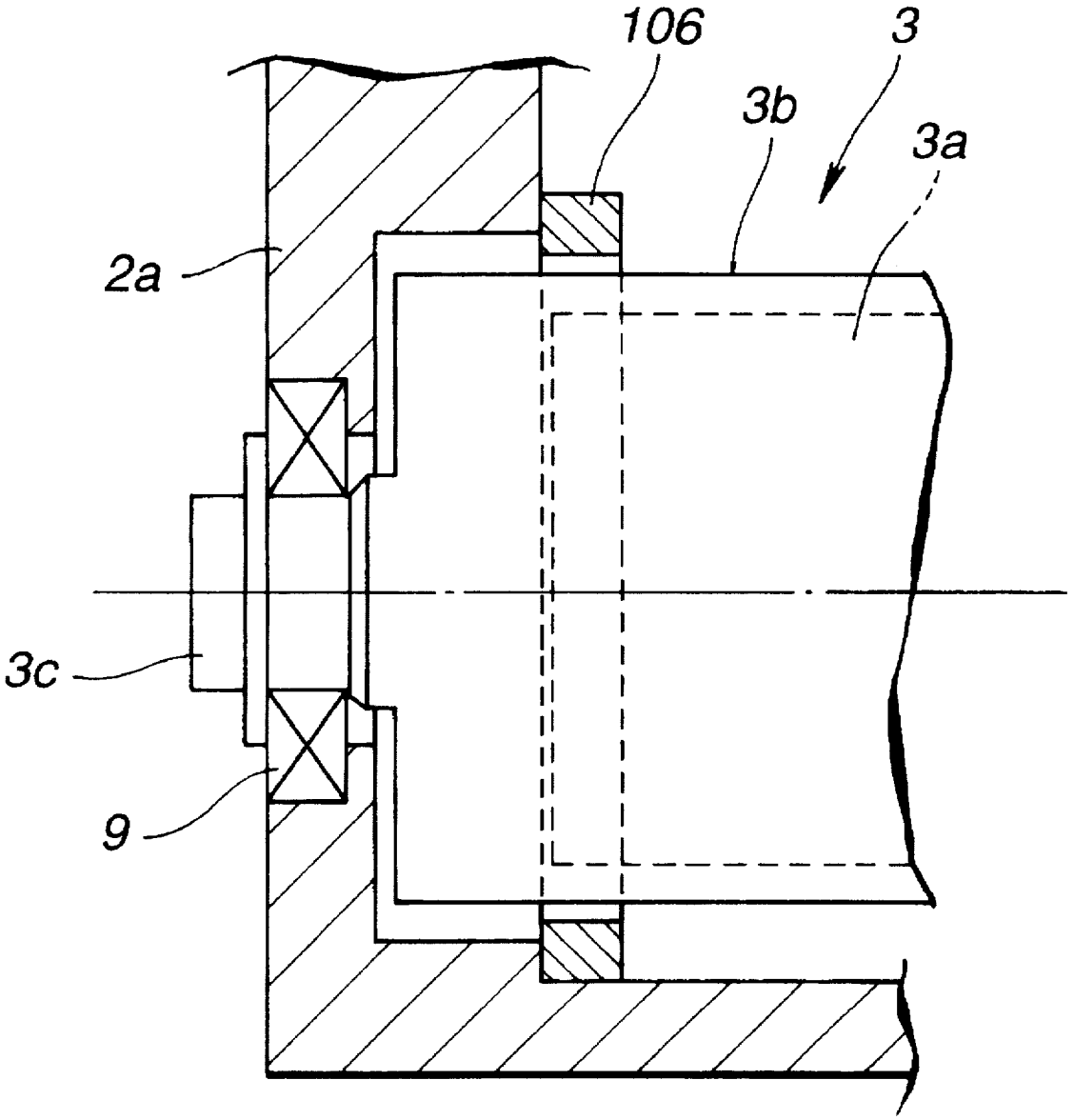
FIG. 10 is a cross-sectional front view of an end portion of the developing device shown in FIG. 9.
Figure 11:
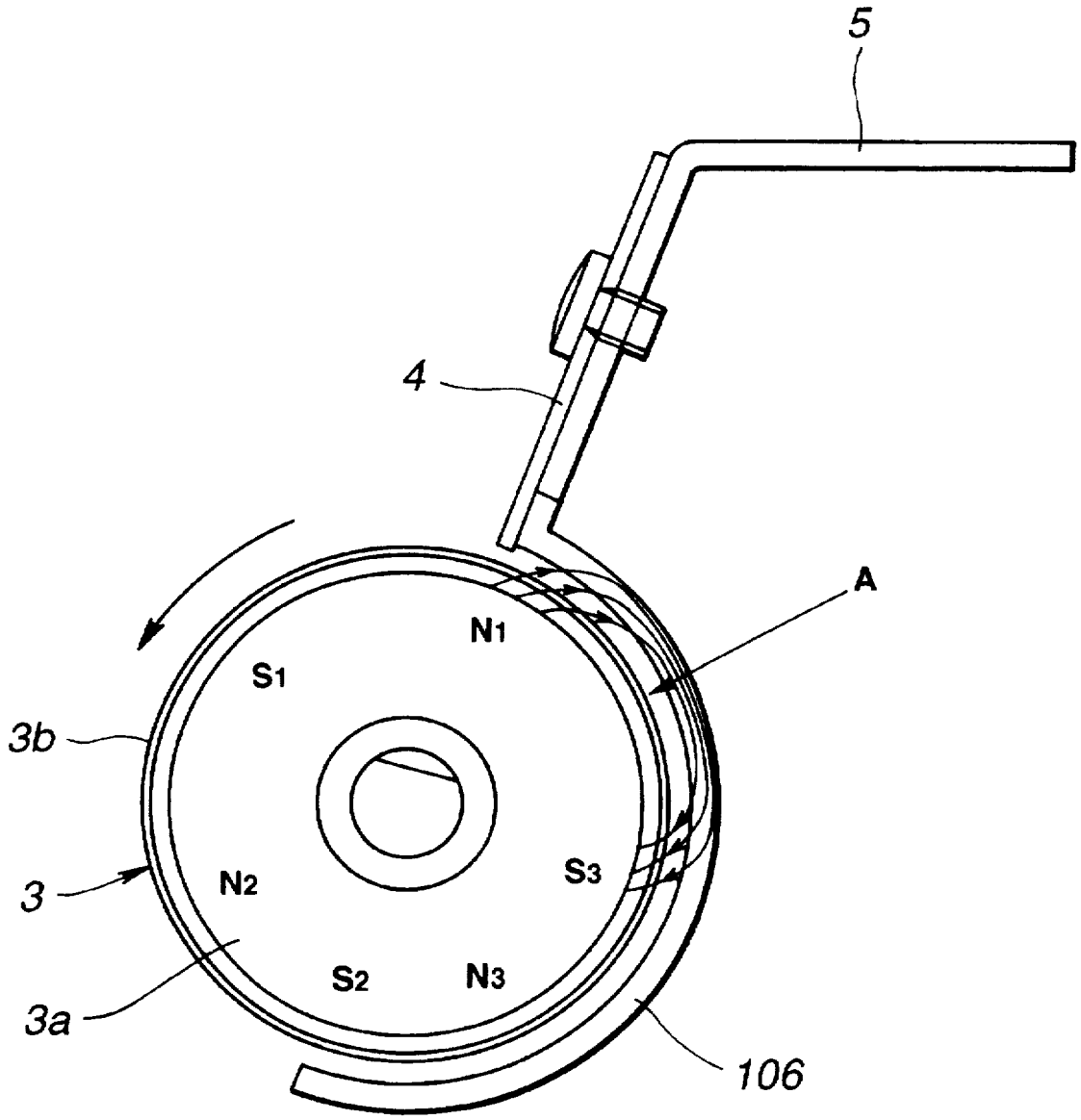
FIG. 11 is an enlarged view of a principal portion of the developing device shown in FIG. 9.

Next, a description will be provided of the developing device 1 of the first embodiment. In the developing device 1 shown in FIG. 1, a description of components having the same reference numerals as those shown in FIG. 9 will be omitted.

In the first embodiment, a plurality of grooves 6*a* are formed in the inner surface of each of magnetic members 6 (corresponding to the magnetic members 106 in the conventional approach) facing a developing roller 3, serving as a magnetic-particle bearing member or a developer bearing member.

Figure 2:
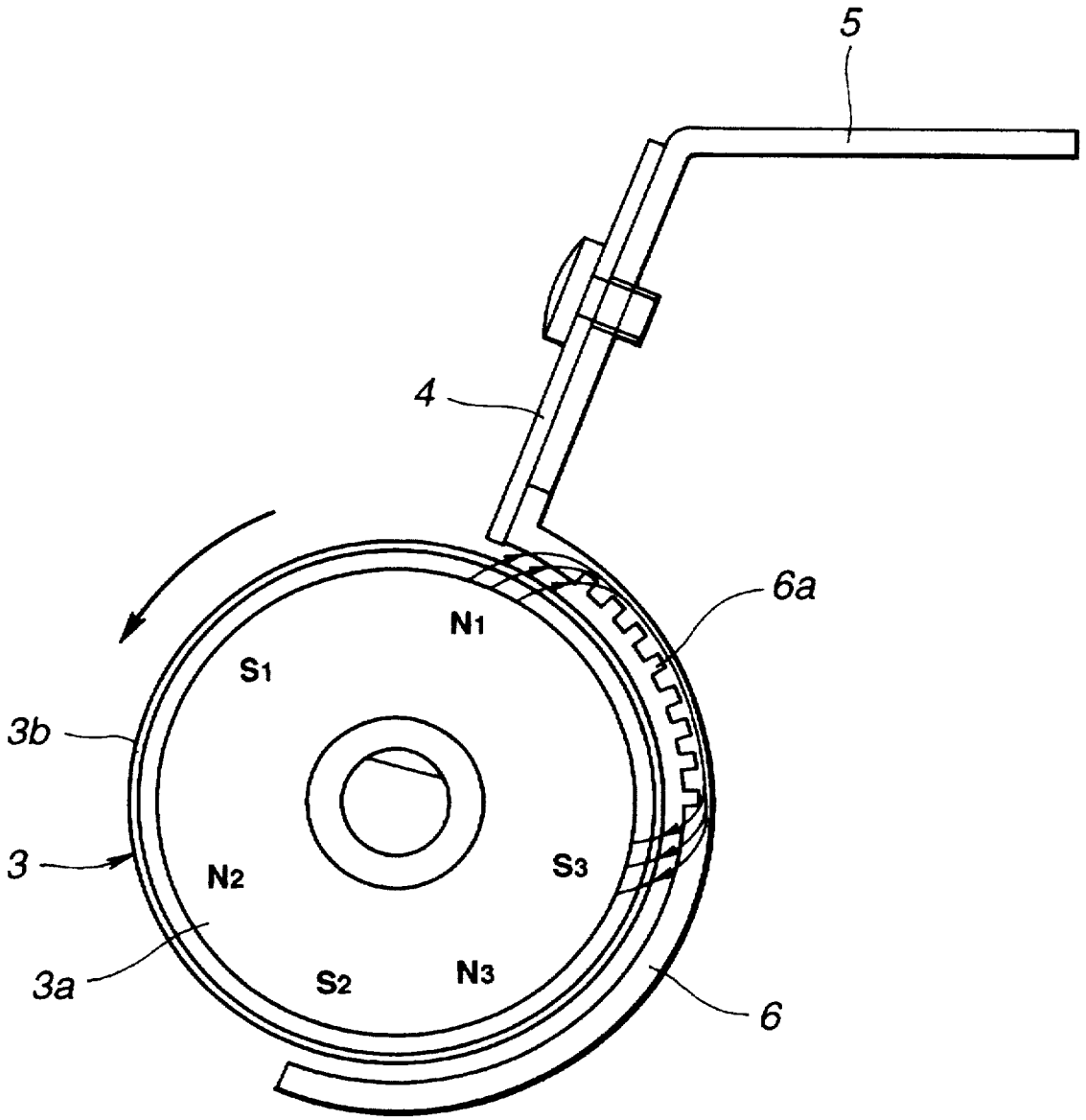
FIG. 2 is an enlarged cross-sectional view of a principal portion of the developing device shown in FIG. 1.
Figure 3:
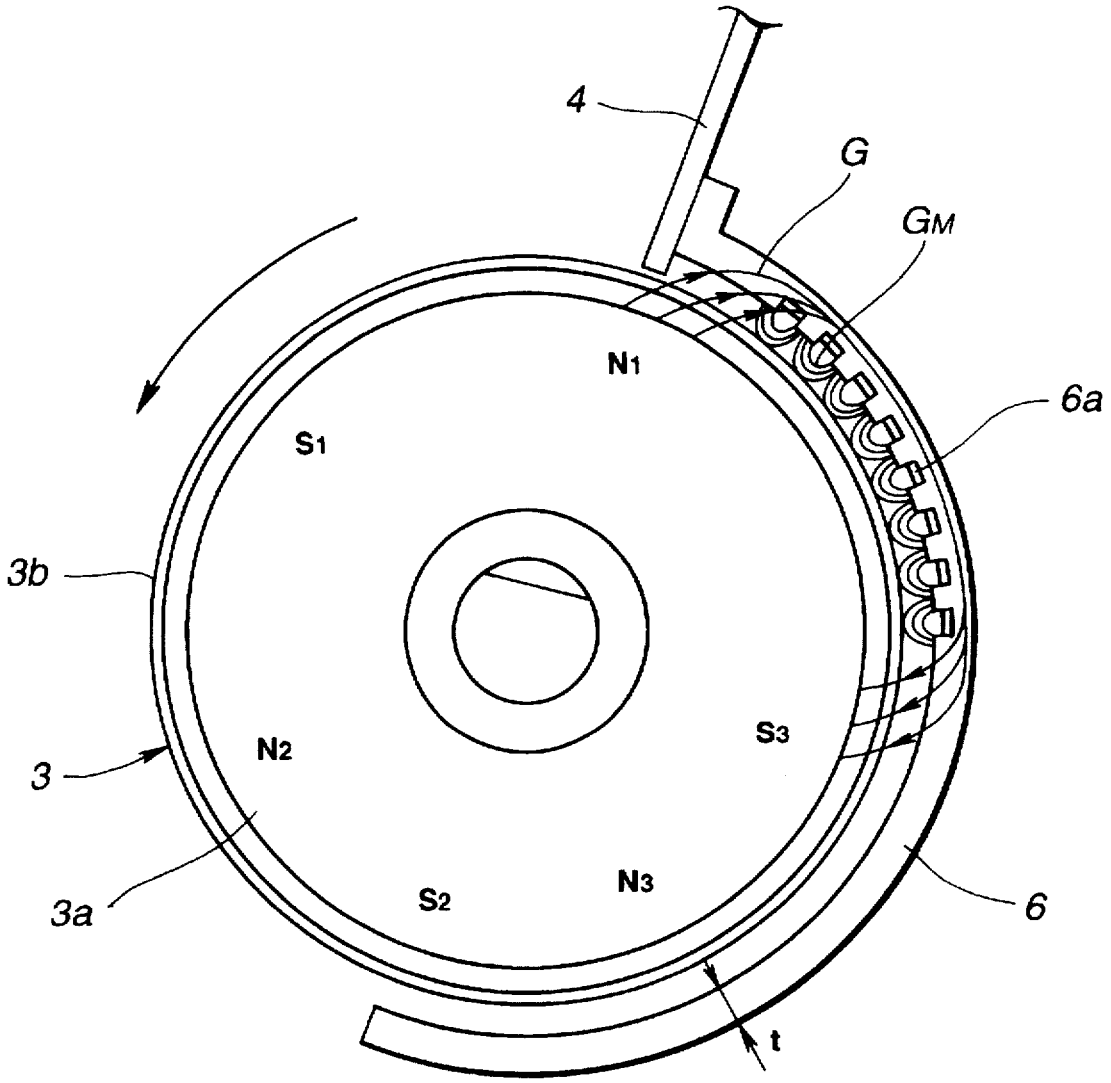
FIG. 3 is a further enlarged cross-sectional view of the principal portion of the developing device shown in FIG. 2.

As shown in FIGS. 2 and 3, the grooves 6*a* are formed on the inner surface at a substantially equal pitch. The width of the groove 6*a* is about 0.2–3 mm, and the depth of the groove 6*a* is about 0.2 t–0.8 t, where t is the thickness of the magnetic member 60. It is thereby possible to generate a sufficient leakage magnetic force to completely prevent the leakage of the developer to the outside in the groove portion, and to maintain a sufficient strength of the magnetic members 6.

Figure 5:
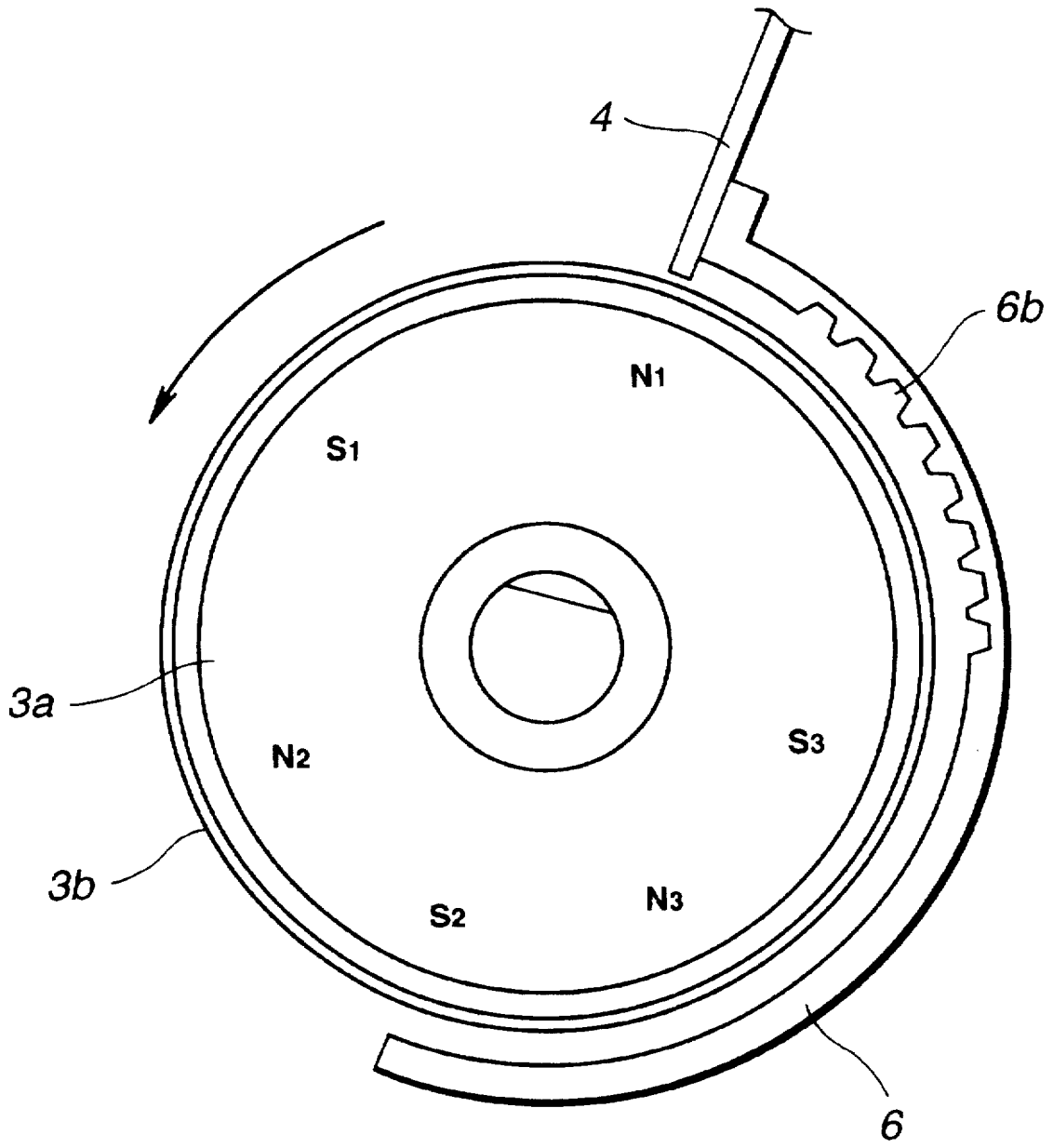
FIGS. 5 and 6 are enlarged cross-sectional views illustrating other examples of a magnetic member shown in FIGS. 2 and 3.
Figure 6:
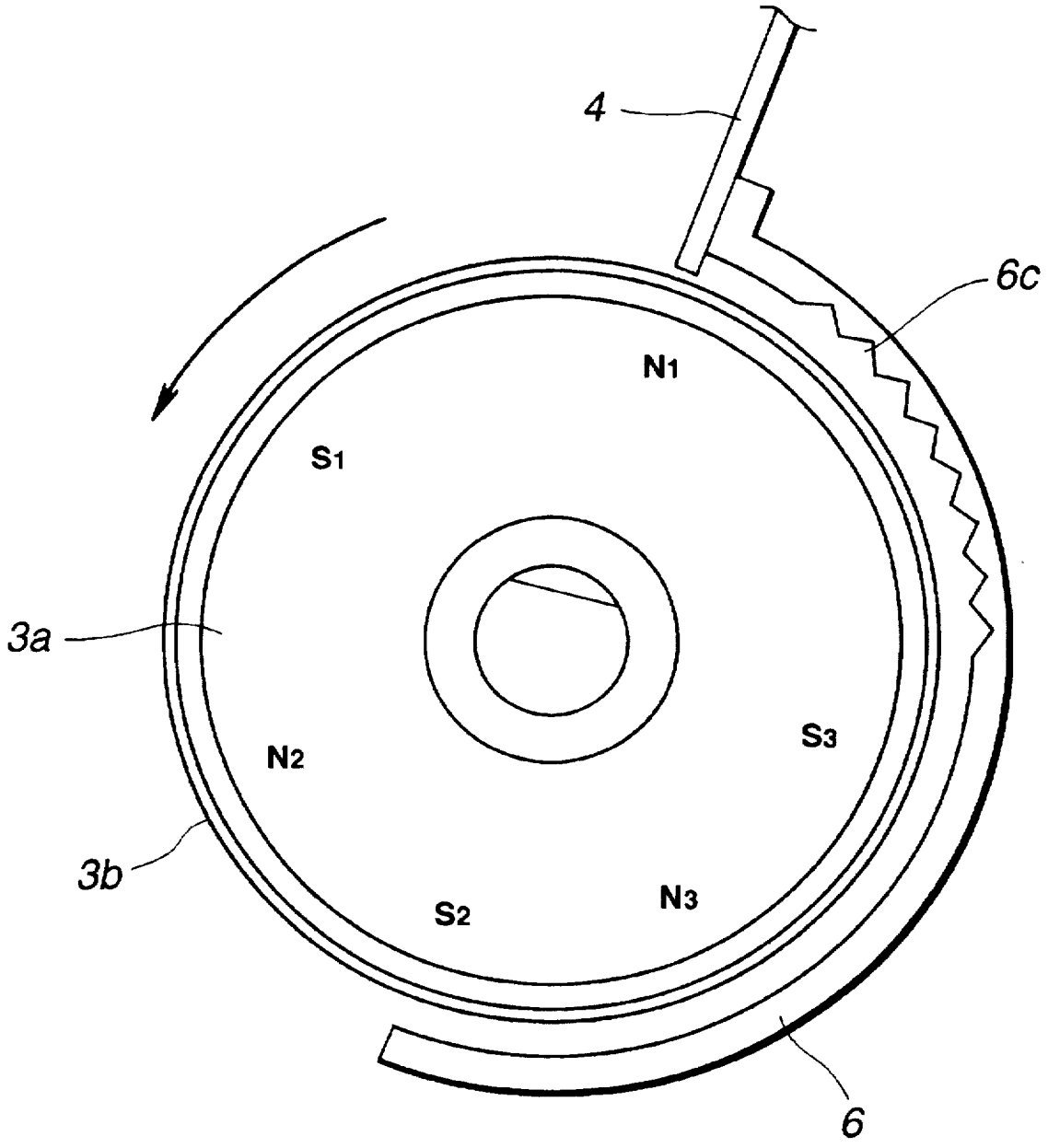

Although in FIGS. 2 and 3, rectangular grooves are shown, the grooves may be trapezoidal as shown in FIG. 5, or may be triangular as shown in FIG. 6.

Although in FIGS. 1 through 3, 5 and 6, the grooves are provided only at a portion of the magnetic member 6, the grooves may be provided over the entire circumference of the magnetic member 6. However, it is preferable to provide the grooves so as to face a portion between magnetic poles having the largest interval.

The magnetic members 6 are preferably made of a ferromagnetic material, such as iron, nickel, cobalt, or an alloy of at least two of these elements.

Although in the first embodiment, the magnetic members 6 are circular and have the same center as the developing sleeve 3*b*, the shape of the magnetic members 6 is not limited to the illustrated one.

Figure 1:
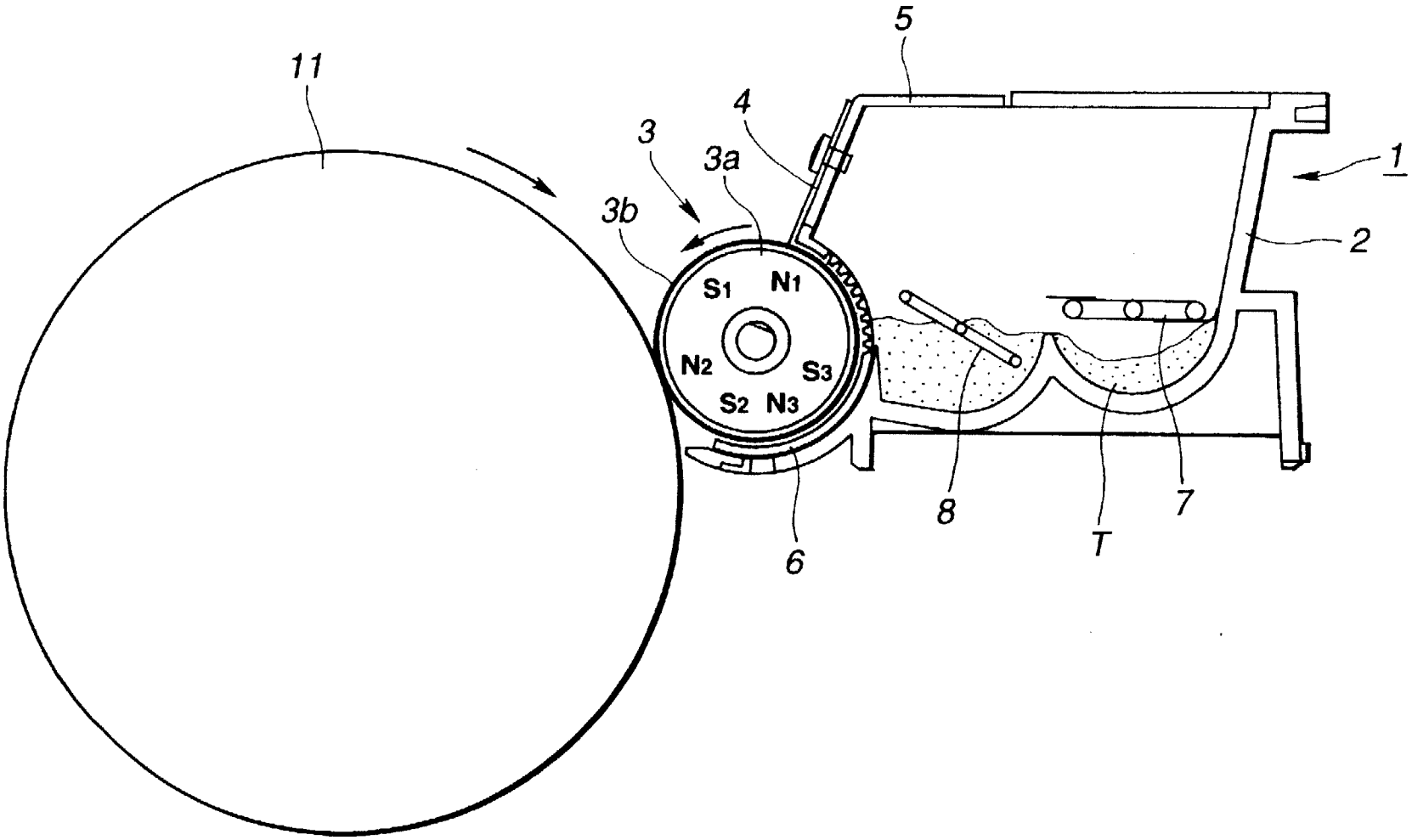
FIG. 1 is a cross-sectional view of a developing device according to a first embodiment of the present invention.

The magnetic members 6 are preferably provided over the entire circumference of the developing sleeve 3*b*. However, as shown in FIG. 1, the magnetic members 6 may not be provided over the entire circumference of the developing sleeve 3*b*.

By thus providing the magnetic members 6 so as to face both end portions of the developing sleeve 3*b*, the magnetic members 6 are magnetized by the magnetic force of the magnet roller 3*a* provided within the developing sleeve 3*b*, and as shown in FIG. 3, a leakage magnetic field GM is generated in the grooves 6*a* to form a magnetic brush comprising the developer at a gap portion between the magnetic members 6 and the developing sleeve 3*b*.

The magnetic brush prevents the leakage of the developer. By thus providing the leakage magnetic field at a portion where the magnetic force lacks which is conventionally present between the magnetic poles of the magnetic roller, it is possible to prevent the leakage of the developer, and to realize a high-speed apparatus and a finer developer.

Experiments done by the inventors and others have proved the the developing device having the above-described configuration prevents the leakage of the developer within the developing device to the outside even during the use for a long time period.

Figure 7:
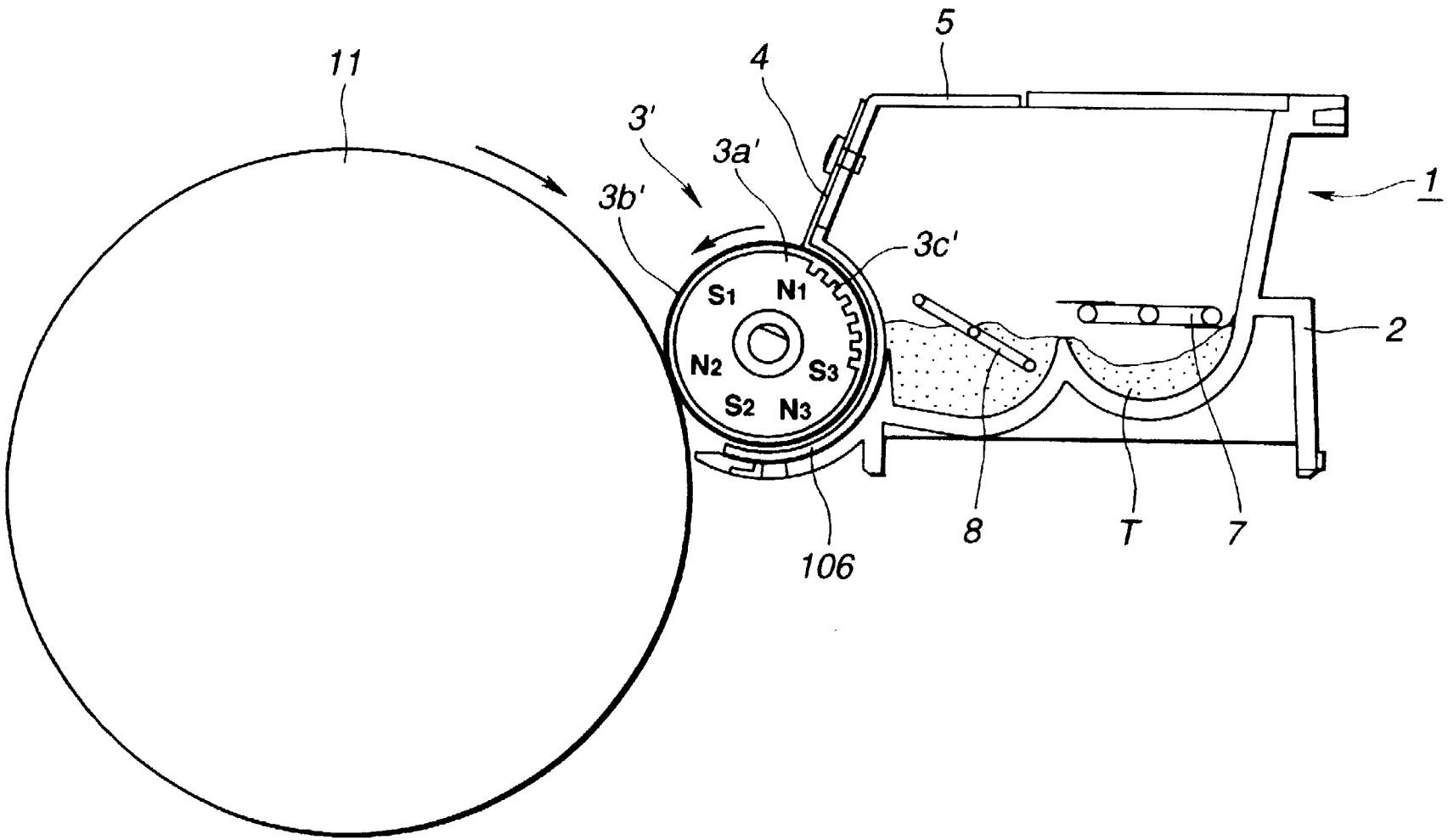
FIG. 7 is a cross-sectional view of a developing device according to a second embodiment of the present invention.
Figure 8:
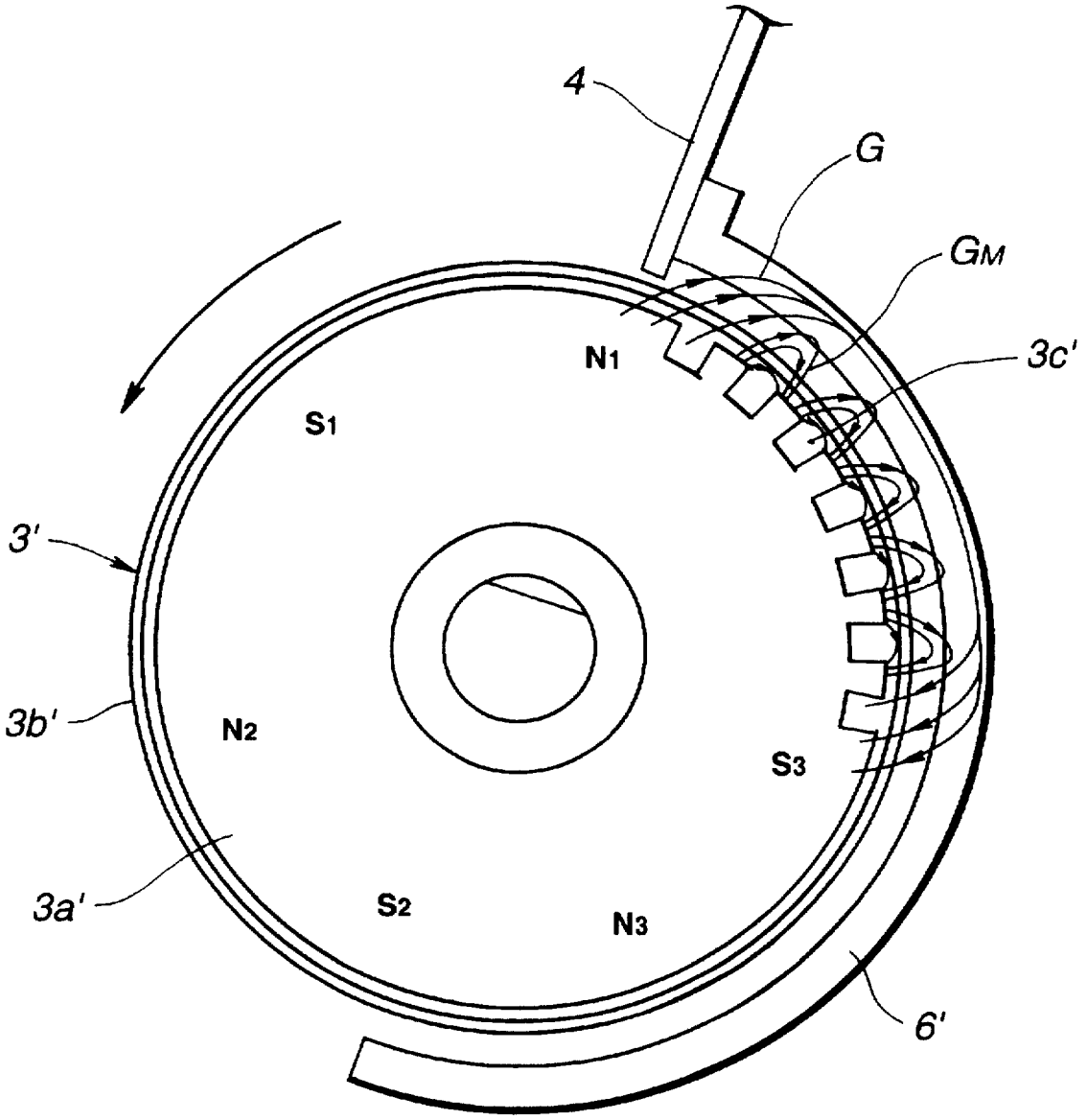
FIG. 8 is a enlarged cross-sectional view of a principal portion of the developing device shown in FIG. 7.

Next, a description will be provided of a second embodiment of the present invention with reference to FIGS. 7 and 8. In FIGS. 7 and 8, components having the same functions as those in the first embodiment are indicated by the same reference numerals, and a description thereof will be omitted.

As shown in FIGS. 7 and 8, the same functions as in the first embodiment can also be obtained by forming grooves 3c' in the surface of each of both end portions of a magnet roller 3a' within a developer bearing member 3' instead of forming grooves in the inner surface of the magnetic member. In the second embodiment, also, the grooves 3c' are formed at a portion between magnetic poles having the largest interval. As in the case of the grooves in the magnetic members, the shape of the grooves is not limited to the illustrated ones and the grooves may be formed over the entire circumference of the magnet rollers The individual components shown in outline in the drawings are all well-known in the developing device arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developing device comprising:

a developer bearing member for bearing and conveying a magnetic developer;

a magnetic-field forming member provided within said developer bearing member; and a magnetic member, provided so as to face end portions of said developer bearing member with a gap, for forming a magnetic seal by a magnetic field formed between said magnetic members and said magnetic-field forming members, wherein said magnetic member includes a plurality of grooves formed in a surface facing said developer bearing member.

2. A device according to claim 1, wherein said magnetic members is provided along a moving direction of said developer bearing member.

3. A device according to claim 1, wherein each of the grooves is provided along a longitudinal direction of said developer bearing member.

4. A device according to claim 1, wherein the grooves have a width of 0.2–3 mm.

5. A device according to claim 1, wherein the grooves have a depth of 0.2 t–0.8 t, where t is a thickness of said magnetic member).

6. A device according to claim 1, wherein said magnetic member is made of one of iron nickels cobalt and an alloy of at least two of these elements.

7. A device according to claim 1, wherein said magnetic-field forming member includes a plurality of magnetic poles, and wherein the grooves are provided so as to face at least a portion between magnetic poles having a largest interval.

8. A device according to claim 1, wherein the grooves are rectangular in cross section.

9. A device according to claim 1, wherein the grooves are formed over an entire surface of said magnetic member.

10. A device according to claim 1, wherein the grooves are formed at a substantially equal pitch.

11. A device according to claim 1, wherein the grooves are trapezoidal in cross section.

12. A device according to claim 1, wherein the grooves are triangular in cross section.

13. A developing device comprising:

a developer bearing member for bearing and conveying a magnetic developer;

a magnetic-field forming member provided within said developer bearing member; and a magnetic members, provided so as to face end portions of said developer bearing member with a gap, for forming a magnetic seal by a magnetic field formed between said magnetic member and said magnetic-field forming member;

wherein said magnetic-field forming member includes a plurality of grooves formed in a surface facing said magnetic member.

14. A device according to claim 13, wherein said magnetic member is provided along a moving direction of said developer bearing member.

15. A device according to claim 13, wherein each of the grooves is provided along a longitudinal direction of said developer bearing member.

16. A device according to claim 13, wherein the grooves have a width of 0.2–3 mm.

17. A device according to claim 13, wherein the grooves have a depth of 0.2 t–008 t, where t is a thickness of ethic members.

18. A device according to claim 13, wherein said magnetic member is made of one of iron, nickel, cobalt, and an alloy of at least two of these elements.

19. A device according to claim 13, wherein said magnetic-field forming member includes a plurality of magnetic poles, and wherein the grooves are provided at at least a portion between magnetic poles having a largest interval.

20. A device according to claim 13, wherein the grooves are rectangular-in cross section.

21. A device according to claim 13, wherein the grooves are formed over an entire surface of said magnetic member.

22. A device according to claim 13, wherein the grooves are formed at a substantially equal pitch.

23. A device according to claim 13, wherein the grooves are trapezoidal in cross section.

24. A device according to claim 13, wherein the grooves are triangular in cross section.

* * * * *

UNITED STATES PATENT AND TRADEMARK OFFICE

CERTIFICATE OF CORRECTION

PATENT NO. : 5,895,144

DATED : April 20, 1999

INVENTOR(S) : AKIMASA NISHIMURA

It is certified that error appears in the above-identified patent and that said Letters Patent is hereby corrected as shown below:

COVER PAGE AT ITEM [73]
"JPX" should be deleted.

COLUMN 1,
Line 6, "devices" should read --device,--; and
Line 18, "devices" should read --device.--.

COLUMN 2,
Line 41, "developers" should read --developer,--.

COLUMN 3,
Line 51, "systems" should read --system.--.

COLUMN 4,
Line 62, "the" (1st occurrence) should read --that--.

COLUMN 5,
Line 15, "rollers" should read --roller.--;
Line 46, "members" should read --member--;
Line 55, "member)." should read --member.--; and
Line 57, "iron nickels cobalt" should read --iron, nickel, cobalt,--.

UNITED STATES PATENT AND TRADEMARK OFFICE

CERTIFICATE OF CORRECTION

PATENT NO. : 5,895,144

DATED : April 20, 1999

INVENTOR(S) : AKIMASA NISHIMURA

It is certified that error appears in the above-identified patent and that said Letters Patent is hereby corrected as shown below:

COLUMN 6,
Line 21, "members" should read --member,--;
Line 38, "0.2t-008t," should read --0.2t-0.8t,--, and
"ethic" should read --said magnetic--; and
Line 48, "rectangular-in" should read --rectangular in--.

Signed and Sealed this

Eighteenth Day of January, 2000

*Attest:*

Q. TODD DICKINSON

*Attesting Officer*

*Commissioner of Patents and Trademarks*